US007107780B2

(12) United States Patent
Bellini et al.

(10) Patent No.: US 7,107,780 B2
(45) Date of Patent: Sep. 19, 2006

(54) VACUUM-BREAKING VALVE FOR A REFRIGERATED COMPARTMENT

(75) Inventors: Jacqueline Ferrão Lampert Bellini, Joinville (BR); Guido Gárcia Bernardelli, Joinville (BR); Juarez Medeiros de Souza, Joinville (BR); Edson Adriano da Silva, Joinville (BR)

(73) Assignee: Multibras S.A. Electrodomesticos, Sao Paulo (BR)

( * ) Notice: Subject to any disclaimer, the term of this patent is extended or adjusted under 35 U.S.C. 154(b) by 541 days.

(21) Appl. No.: 10/129,941

(22) PCT Filed: Mar. 15, 2001

(86) PCT No.: PCT/BR01/00025

§ 371 (c)(1),
(2), (4) Date: Sep. 11, 2002

(87) PCT Pub. No.: WO02/48626

PCT Pub. Date: Jun. 20, 2002

(65) Prior Publication Data

US 2003/0054752 A1 Mar. 20, 2003

(30) Foreign Application Priority Data

Dec. 11, 2000 (BR) ..... 0006442

(51) Int. Cl.

| | |
|---|---|
| ***F25D 23/06*** | (2006.01) |
| ***F25D 15/00*** | (2006.01) |
| ***F16K 15/00*** | (2006.01) |
| ***F16K 17/00*** | (2006.01) |
| ***F16K 21/04*** | (2006.01) |

(52) U.S. Cl. ..... 62/273; 62/331; 137/533.27; 137/543.15

(58) Field of Classification Search ..... 62/273, 62/331, 409; 137/533.27, 543.15; 220/2.2, 220/89.1

See application file for complete search history.

(56) References Cited

U.S. PATENT DOCUMENTS

| | | | | | |
|---|---|---|---|---|---|
| 3,952,542 | A | * | 4/1976 | Berkowitz | 62/409 |
| 4,569,208 | A | | 2/1986 | Villa | 62/273 |
| 4,938,254 | A | | 7/1990 | Gimby | 137/541 |
| 5,271,240 | A | * | 12/1993 | Detrick et al. | 62/268 |
| 5,836,170 | A | * | 11/1998 | Perkins et al. | 62/409 |
| 6,176,776 | B1 | * | 1/2001 | Finkelstein et al. | 454/195 |
| 6,672,094 | B1 | * | 1/2004 | Carden et al. | 62/273 |
| 6,672,096 | B1 | * | 1/2004 | Lopes | 62/331 |

FOREIGN PATENT DOCUMENTS

| | | |
|---|---|---|
| EP | 030 046 | 6/1981 |
| FR | 547 385 | 11/1968 |
| GB | 552 | 8/1956 |

* cited by examiner

*Primary Examiner*—Cheryl Tyler
*Assistant Examiner*—Filip Zec
(74) *Attorney, Agent, or Firm*—Darby & Darby

(57) ABSTRACT

A vaccum-breaking valve comprising: a tubular body (10) mounted through one of the walls (P) of the cabinet (G) and having inner (11) and outer (12) ends, a valve seat (15) defining a fluid communication between the inside and the outside of cabinet (G); and a seal constantly biased towards a closed position, blocking said fluid communication and dispalceable towards an open valve position. The seal comprises a slide (20), which is axially and slicingly mounted through the valve seat (15) and has a surrounding sealing ring (25), which is seated against the valve seat (15) when the slide (20) is displaced to the closed seal position, the slide (20) being provided with at least one air passage (24) interconnecting the upstream and downstream sides of the valve seat (15) when the slide (20) is in the open seal position.

7 Claims, 1 Drawing Sheet

VACUUM-BREAKING VALVE FOR A REFRIGERATED COMPARTMENT

RELATED APPLICATIONS

This application claims priority under 35 U.S.C. §371 based on International Application No. PCT/BR01/00025, filed Mar. 15, 2001, which was published on Jun. 20, 2002, as International Publication No. WO 02/48626, claiming priority to Brazilian Patent Applications Ser. No. PI0006442-4, filed Dec. 11, 2001, of which are incorporated herein by reference.

FIELD OF THE INVENTION

The present invention refers to a construction of a vacuum-breaking valve to be used in refrigeration appliances in general, such as vertical freezers and refrigerators combined with a freezing compartment, in order to increase the internal pressure inside these appliances and facilitate the reopening of the door.

BACKGROUND OF THE INVENTION

In refrigeration appliances, such as vertical freezers and refrigerators combined with a freezing compartment which have, inside a cabinet G, at least one compartment, which is hermetically closed with good sealing and thermically insulated and inside which the temperature is lower than the temperature of the surrounding external environment, there is observed an undesired effect which tends to make difficult the immediate reopening of the door of said refrigeration appliance after it has been opened and closed.

This phenomenon is due to the decrease in the pressure of the air mass admitted to the inside of the refrigerated compartment upon the opening of the door, which is inherent to the decrease in temperature of said air mass after the closing of the door, producing an unbalance between the internal pressure, which is lower, and the external pressure, which is higher.

As a result, a strong vacuum is produced inside the cabinet, resulting in a force on the door acting to keep it closed, and consequently making difficult the immediate reopening thereof. At present, it is recommended that the user wait a few minutes before reopening the door.

In order to overcome this problem and allow users to reopen the cabinet door immediately after its closing and with less effort, a device known as vacuum-breaking valve is used, whose function is to promote the equalization of the internal and external pressures. This valve is comprised of a generally cylindrical and rectilinear tubular body, which crosses one of the walls of the cabinet G of the refrigeration appliance, in order to promote a fluid communication between the inside and the outside thereof and to allow, in certain occasions (notably when the internal pressure is lower than the external pressure), the external air to enter the cabinet, thus increasing the internal pressure until it becomes close to the external pressure, represented by the atmospheric pressure. The tubular body is open on its inner side and has on its outer side a sealing system consisting of a movable seal, which is activated by gravity and is movable between a sealing position when in rest, seated on a valve seat and promoting the sealing of the air passage, and a spaced position, when it is maintained suspended and spaced from the valve seat, due to the difference between the external and internal pressures of the cabinet, thus enabling the air flow to the inside thereof.

The tubular body of the valve may be formed of a thermically conductive material, having its outer end arranged in order to define a heat collector to collect thermal radiation coming from a heat source available in the refrigeration appliance and which can be defined by the compressor. This construction allows the tubular body of the valve to be kept warm enough to prevent ice formation therein, due to the condensation of the air that enters when the valve is open, without interfering with the cooling inside the cabinet. This construction is described in the patent application BR PI0001249-1, of the same applicant.

While operating adequately, mainly when the tubular body of the valve is built of a material with good thermal conductivity and is kept slightly heated, the constructive arrangement of the seal suggested in the prior art uses the force of gravity to keep the seal, in the form of a sphere, seated on the valve seat, sealing the fluid communication between the inside and the outside of the cabinet.

Due to the fact that the seal is gravitationally and vertically displaced between a closed position, seated on the valve seat, and an open position, elevated in relation to the valve seat by action of the pressure difference between the inlet and outlet ends of the tubular body, it should be built in order to be light enough to be suspended by the "vacuum" formed inside the cabinet, particularly when the user starts the movement of reopening the door immediately after a closing thereof.

The construction of the usual spherical seal with a light spherical body is relatively costly and complex, besides allowing surface irregularities, such as barbs, to be formed on the spherical body of the seal. The low weight of these seals and the presence of surface irregularities thereon makes little efficient the closing of the valve seat only by the gravitational seating of a very light and small sphere against the sealing seat of the valve. On the other hand, the use of a heavier seal would make impracticable its upward displacement by pressure difference.

Therefore, in these known solutions, the construction of the seal is determined by the weight limitations, which weight should also be determined so that the valve only opens when the user starts a door reopening, in order to avoid that the presence of the pressure difference after each closing of the door causes the opening of the valve and the admission of external humid air inside the cabinet, even without an immediate reopening of the door. The adequate operation of the valve thus depends on the weight of the seal and the precision of its finishing, even if the limit weight is insufficient to promote an efficient sealing in the closed valve condition.

An inadequate sealing of the valve seat allows the occurrence of a flow of external humid air to the inside of the cabinet any time the internal pressure thereof is lower than the external pressure, causing undue ice formation inside the refrigerated compartment.

OBJECTIVE OF THE INVENTION

It is the object of the present invention to provide a vacuum-breaking valve for refrigerated compartments of simple construction and reliable operation, which allows the admission of external air to the inside of the cabinet to which it is installed only when the cabinet door is reopened by the user, immediately after a previous closing, assuring a high degree of sealing when in a closed position.

DISCLOSURE OF THE INVENTION

The objective above is achieved with the provision of a vacuum-breaking valve for a refrigerated compartment closed by a door operated by the user, said valve comprising: a tubular body mounted through one of the walls of the cabinet and having inner and outer ends, which are respectively open to the inside and the outside of the cabinet; a valve seat provided on the outer end of the tubular body and defining a fluid communication between the inside and the outside of the cabinet; and a seal mounted to the tubular body and constantly biased towards a closed position, in which it is seated against said valve seat, blocking said fluid communication and movable towards an open position, spaced from the valve seat, establishing said fluid communication.

According to the invention, the seal comprises a slide, which is axially and slidingly mounted through the valve seat and has a closed end portion and an opposite end portion, which are interconnected by a peripheral lateral contour carrying a surrounding sealing ring, which is seated against the valve seat when the slide is displaced to the closed seal position and which is spaced away from the valve seat when the slide is displaced to the open seal position, the slide being provided with at least one air passage connecting the opposite end portion of the slide with a region of the peripheral lateral contour located between said opposite end portion and the surrounding sealing ring, said air passage being upstream the valve seat when the slide is in the closed seal position and interconnecting the upstream and downstream sides of the valve seat when the slide is in the open seal position.

BRIEF DESCRIPTION OF THE DRAWINGS

The invention will be described below, with reference to the appended drawing, in which.

BEST MODE OF CARRYING OUT THE INVENTION

Figure 1:
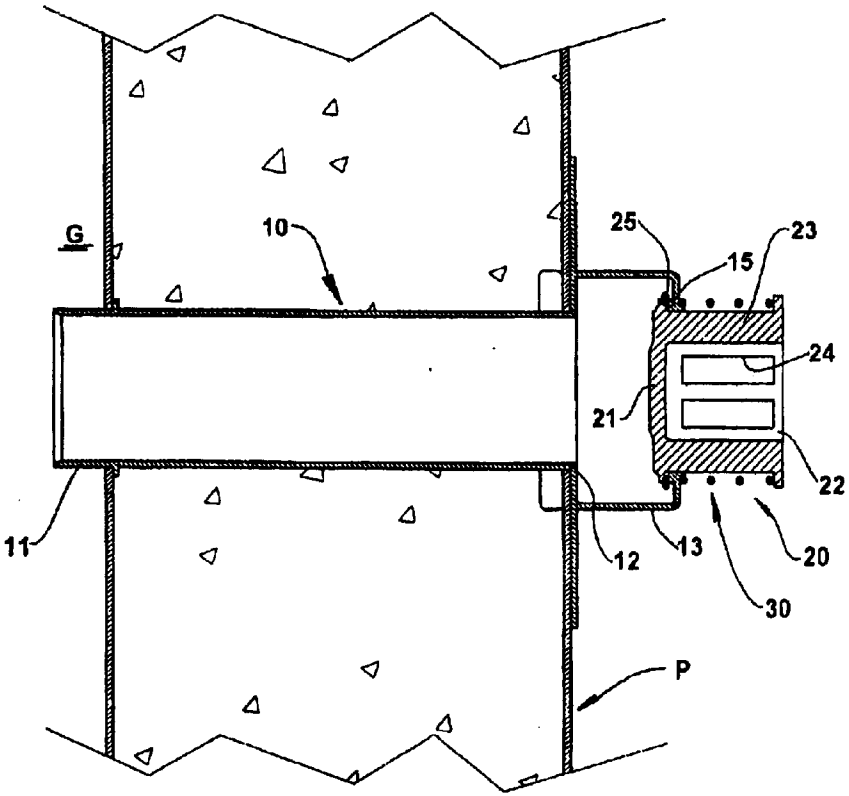
FIG. 1 is a rather schematic representation of a vertical longitudinal section of the vacuum-breaking valve of the present invention in the closed position and installed through a wall of a refrigerated cabinet.

As mentioned above, the present vacuum-breaking valve is of the type comprising a tubular body 10, which is preferably cylindrical and formed of a thermically conductive material, mounted through one of the walls P of a refrigerated cabinet G, closed by a door (not illustrated) to be operated by the user.

The tubular body 1 has an inner end 11 open to the inside of cabinet G and an outer end 12 open to the outside of the cabinet and preferably arranged in order to define a collector for the heat irradiated by the compressor of the refrigeration system or by any other heat source available to the refrigeration appliance.

Inside the outer end 12 of the tubular body 10 a valve seat 15 is incorporated, defining a generally circular opening in order to establish fluid communication between the inside and the outside of cabinet G through the tubular body 10.

In the illustrated embodiment, the valve seat 15 is defined by an annular flange internally incorporated in an elongated portion 13 of the outer end 12 of the tubular body 10, which elongated portion 13 coaxially projects from the outer face of the wall P of cabinet G and may present a contour that is geometrically equal to, similar to or different from the rest of the tubular body 10 and may be constructed as a separate piece.

The vacuum-breaking valve further comprises a seal in the form of a slide 20, which is axially and slidingly mounted through a valve seat 15 so that it may be displaced between a closed position, in which it blocks the valve seat 15 and the fluid communication between the inside and the outside of cabinet G, and an open position, allowing the establishment of said fluid communication through the valve seat 15.

In the illustrative configuration shown in the drawings, the slide 20 takes the form of a an elongated prismatic body having a cross-section similar to and slightly smaller than the cross-section of the valve seat 15, preferably cylindrical, said slide having a closed end portion 21 and an opposite end portion 22, which are interconnected by a peripheral lateral contour 23. In the illustrated construction, the slide 20 is tubular, with the opposite end portion 22 opened and with the peripheral lateral contour 23 provided with at least one window 24, which defines, with the hollow interior and the open opposite end portion 22, an air passage, whose function will be described below.

The slide 20 carries, externally, on its closed end portion 21, a surrounding sealing ring 25 located downstream the valve seat 15 and seated against the latter when the slide 20 is displaced to the closed seal position, blocking the fluid communication between the inside and the outside of cabinet G. The sealing ring 25 is preferably built of an elastomer, in order to facilitate the achievement of a high level of tightness at the interfaces thereof with the slide 20 to which it is mounted and with the valve seat 15 when seated thereon.

The positioning of the valve seat 15 and sealing ring 25 on the respective parts that carry them is made in order that, when the slide 20 is in the closed seal position, with the sealing ring 25 seated against the valve seat 15, the opposite end portion 22 of the slide 20 remains markedly projected outwardly from the tubular body 10.

In order that the slide 20 be constantly biased towards the closed seal position (FIG. 1), a spring 30 is provided around the slide 20 and upstream the sealing ring 25 and has an end seated against a stop 22*a* incorporated to the opposite end portion 22 of the slide 20 and the other end seated against the outer end 12 of the tubular body 10.

The spring 30 is dimensioned to be compressed, allowing the displacement of the slide 20 towards the tubular body 10, spacing the sealing ring 25 from the valve seat 15 and opening the valve when a reopening of the cabinet door is started immediately after a previous closing.

The spring 30 is dimensioned to yield only upon the sudden increase of the level of "vacuum" or of the sub-pressure present in cabinet G soon after the closing of the door, when the user starts an immediate reopening. If the door is not reopened, the sub-pressure level present soon after a closing of the door is not sufficient to provide, on the slide 20, enough axial force to compress the spring 30.

While only one embodiment of the vacuum-breaking valve has been illustrated, it should be understood that modifications could be made within the same constructive concept disclosed herein. For example, the slide 20 is not necessarily tubular, since each air passage may be formed by a respective longitudinal groove provided on the lateral peripheral contour 23 of the slide 20, upstream the sealing ring 25. The spring 30 may also take different forms, as long as it assures the closing of the valve during the usual operation of cabinet G, allowing its opening only when a reopening of the door is started immediately after being closed.

Figure 2:
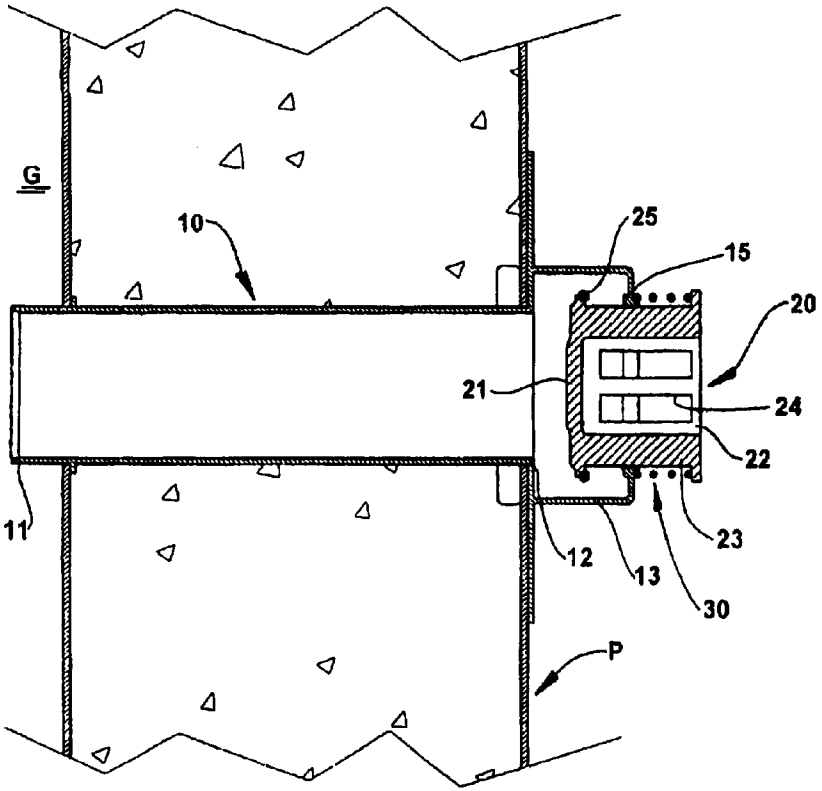
FIG. 2 is a view similar to that of FIG. 1, illustrating the valve in the open condition.

When the slide 20 is displaced towards the open seal position, each window 24 occupies a position at least partially located downstream the valve seat 15 (FIG. 2), establishing a fluid communication between the inside and the outside of cabinet G through the tubular body 10,valve seat 15 and each air passage 24, 22 provided on the slide 20.

The constructive arrangement described above allows the door to be easily reopened by the user, without the need of additional effort or special handles for increased manual grip, besides allowing an efficient sealing of the valve when in the closed position.

What is claimed is:

1. A vacuum-breaking valve for a refrigerated cabinet closed by a door operated by the user, said valve comprising:

a tubular body mounted through one of the walls of the cabinet and having inner and outer ends, which are respectively opened to the inside and to the outside of cabinet;

a valve seat provided on the outer end of the tubular body and defining a fluid communication between the inside and the outside of the cabinet; and a seal mounted to the tubular body and constantly biased towards a closed position and seated against said valve seat, blocking the valve seat, and displaceable towards an open position, spaced from the valve seat, opening the valve seat; wherein the seal comprises:

a slide axially and slidingly mounted through the valve seat and has a closed end portion and an opposite end portion, which are interconnected by a peripheral lateral contour carrying a surrounding sealing ring, which is seated against the valve seat when the slide is displaced to the closed seal position and which is spaced away from the valve seat when the slide is displaced to the open seal position;

wherein the slide being provided with at least one air passage connecting the opposite end portion of the slide with a region of the lateral peripheral contour located between said opposite end portion and the sealing ring, said air passage being upstream the valve seat when the slide is in the closed seal position and interconnecting the upstream and downstream sides of the valve seat when the slide is in the open seal position, said slide has a tubular shape, with the opposite end portion axially opened, each air passage being defined by a window provided on the peripheral lateral contour, connecting the latter with the open opposite end portion of the slide.

2. The valve, according to claim 1, characterized in that the slide is constantly biased towards the closed seal position by action of a spring with its ends respectively acting against the opposite end portion of the slide and the outer end of the tubular body.

3. The valve, according to claim 2, characterized in that the spring is provided around the peripheral lateral contour of the slide upstream the sealing ring.

4. The valve, according to claim 1, characterized in that the slide has a cross-section similar to and slightly smaller than the cross-section of the valve seat.

5. The valve, according to claim 1, characterized in that the valve seat is defined by an annular flange internally incorporated in an elongated portion of the outer end of the tubular body.

6. The valve, according to claim 5, characterized in that the elongated portion is coaxial to the tubular body.

7. Valve, according to claim 1, characterized in that the sealing ring is an elastomer.

* * * * *

UNITED STATES PATENT AND TRADEMARK OFFICE

CERTIFICATE OF CORRECTION

PATENT NO. : 7,107,780 B2
APPLICATION NO. : 10/129941
DATED : September 19, 2006
INVENTOR(S) : Jacqueline Ferrão Lamper Bellini et al.

It is certified that error appears in the above-identified patent and that said Letters Patent is hereby corrected as shown below:

Title Page Item [73]

In the Assignee:

Please delete "Multibras S.A. Electrodomesticos, Sao Paulo (BR)" and substitute

-- Multibras S.A. Eletrodomesticos, Sao Paulo, SP, (BR) --.

Signed and Sealed this

Twentieth Day of February, 2007

JON W. DUDAS
*Director of the United States Patent and Trademark Office*